US008620198B2

(12) United States Patent
Isobe

(10) Patent No.: US 8,620,198 B2
(45) Date of Patent: Dec. 31, 2013

(54) IMAGE FORMING APPARATUS HAVING A MODE FOR ROTATING A TONER SUPPLY MEMBER IN THE OPPOSITE DIRECTION OF A PREDETERMINED DIRECTION TO INCREASE A TONER AMOUNT

(75) Inventor: Yuta Isobe, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/310,559

(22) Filed: Dec. 2, 2011

(65) Prior Publication Data

US 2012/0148278 A1 Jun. 14, 2012

(30) Foreign Application Priority Data

Dec. 13, 2010 (JP) ..... 2010-277314

(51) Int. Cl.
*G03G 15/08* (2006.01)

(52) U.S. Cl.
USPC ..... 399/281; 399/53

(58) Field of Classification Search
USPC ..... 399/53, 258, 263, 272, 281
See application file for complete search history.

(56) References Cited

U.S. PATENT DOCUMENTS

| | | | | |
|---|---|---|---|---|
| 2005/0063715 | A1* | 3/2005 | Suzuki et al. | 399/27 |
| 2007/0183800 | A1* | 8/2007 | Bessho | 399/49 |
| 2009/0003884 | A1* | 1/2009 | Kawamura et al. | 399/252 |

FOREIGN PATENT DOCUMENTS

| | | | | |
|---|---|---|---|---|
| CN | 1673885 | A | | 9/2005 |
| CN | 101334614 | A | | 12/2008 |
| JP | 58059473 | A | * | 4/1983 |
| JP | 2001-117362 | A | | 4/2001 |
| JP | 2009-009035 | A | | 1/2009 |

* cited by examiner

*Primary Examiner* — Billy J Lactaoen
(74) *Attorney, Agent, or Firm* — Canon U.S.A., Inc., IP Division

(57) ABSTRACT

An image forming apparatus includes a toner supply member which is in contact with the toner carrier and is provided within the container, has a foam layer on its surface, rotates in a predetermined direction for image formation and supplies the toner to the toner carrier and has a contact area with the toner carrier with an uppermost stream position in the predetermined direction of the contact area being higher than a lowermost stream position and has a period when the toner supply member rotates in the opposite direction of the predetermined direction to increase the toner amount contained in the foam layer.

10 Claims, 9 Drawing Sheets

IMAGE FORMING APPARATUS HAVING A MODE FOR ROTATING A TONER SUPPLY MEMBER IN THE OPPOSITE DIRECTION OF A PREDETERMINED DIRECTION TO INCREASE A TONER AMOUNT

BACKGROUND OF THE INVENTION

1. Field of the Invention

The present invention relates to image forming apparatuses which form a latent image on an image carrier by electrophotography or electrostatic recording, for example, and develop the latent image to acquire a visible image.

2. Description of the Related Art

Some developing apparatuses for use in an electrophotography image forming system may have a development roller being a toner carrier which develops an electrostatic latent image and a supply roller being a toner supply member which rotates in contact with the development roller and supplies toner to the development roller. A general supply roller has a urethane sponge layer on its surface as a foam layer for holding toner to be supplied to the development roller. Japanese Patent Laid-Open No. 2009-009035 discloses an example of the developing apparatus. Japanese Patent Laid-Open No. 2009-009035 describes a contact area of a development roller 1 and a supply roller 2 with an uppermost stream position in the direction of rotation of the supply roller set higher than a lowermost stream position, as illustrated in FIG. 9.

SUMMARY OF THE INVENTION

The developing apparatuses of the related art suffer from ineffective use of toner. For example, in the related art, when the contact area of a toner carrier and a toner supply member has an uppermost stream position in the direction of rotation of the toner supply member set higher than a lowermost stream position and when the toner runs short within a development container, toner may stay at an upper part of the abutted position of the toner carrier and toner supply member. The residual toner may not be used effectively for image formation in the related art.

The present invention was made in view of the above-discussed problem of the related art. The present invention provides an apparatus having a contact area of toner carrier and toner supply member with an uppermost stream position in the direction of rotation of the toner supply member set higher than a lowermost stream position, wherein toner staying in an upper part of the contact area of the toner carrier and toner supply member may be effectively used for image formation.

According to an aspect of the present invention, an image forming apparatus of the present invention includes an image carrier which carries an electrostatic latent image, a container which has an opening and contains toner, a toner carrier provided in the opening and carries and conveys the toner to the electrostatic latent image, a toner supply member which is in contact with the toner carrier and is provided within the container, has a foam layer on its surface, rotates in a predetermined direction for image formation and supplies the toner to the toner carrier and has a contact area with the toner carrier with an uppermost stream position in the predetermined direction of the contact area being higher than a lowermost stream position, a detector which detects the toner amount within the container, and a control unit which executes a mode for rotating the toner supply member in the opposite direction of the predetermined direction to increase the toner amount contained in the foam layer in response to the toner amount within the container detected by the detector being equal to or lower than a predetermined amount.

Further features of the present invention will become apparent from the following description of exemplary embodiments with reference to the attached drawings.

DESCRIPTION OF THE EMBODIMENTS

An image forming apparatus of the present invention will be described with reference to drawings below. The following embodiments are for illustrating the present invention, the dimensions, materials, forms, relative positions and so on of the following components do not limit the scope of the present invention, otherwise specified.

With reference to drawings, preferred embodiments of the present invention will be described in detail, for example.

(1) Overall Schematic Configuration of Image Forming Apparatus

Figure 1:
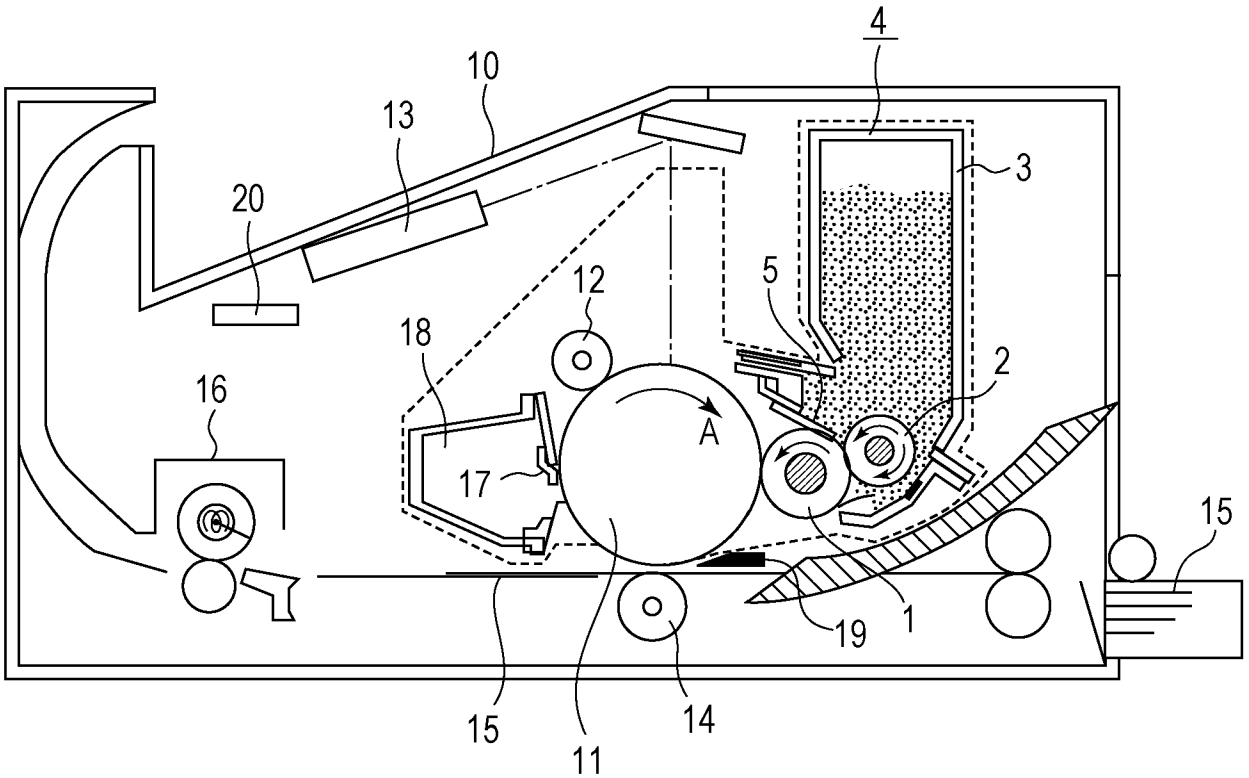
FIG. 1 is a schematic section view illustrating an example of an image forming apparatus applying the present invention.

FIG. 1 is a schematic section view of an image forming apparatus 10 applying the present invention. An outline of image formation processes in the image forming apparatus 10 will be described. Operations by the image forming apparatus are controlled by a CPU 20 which is a control unit. Referring to FIG. 1, a photoconductor drum 11 which is an electrostatic latent image carrier rotates in the arrow A direction. The photoconductor drum 11 is first evenly charged by a charging roller 12 which is a charging apparatus. The photoconductor drum 11 is then exposed with laser light from a laser optical apparatus 13 which is an exposing unit, and an electrostatic latent image is formed on its surface. The electrostatic latent image is developed by a developing apparatus 4 and is visualized as a toner image. The visualized toner image on the photoconductor drum 11 is transferred to recorded sheet 15 which is a transfer material by a transfer roller 14. The excess toner which has not been transferred and is staying on the photoconductor drum 11 is scraped off by a cleaning blade 17 which is a cleaning member and is stored in a waste toner container 18. The cleaned photoconductor drum 11 repeats the operations above for image formation. On the other hand, the recorded sheet 15 to which a toner image has been transferred is fused by a fuser 16 and is then output to the outside of the image forming apparatus.

(2) A Series of Operations for Print Job Processing in Image Forming Apparatus

Figure 2:
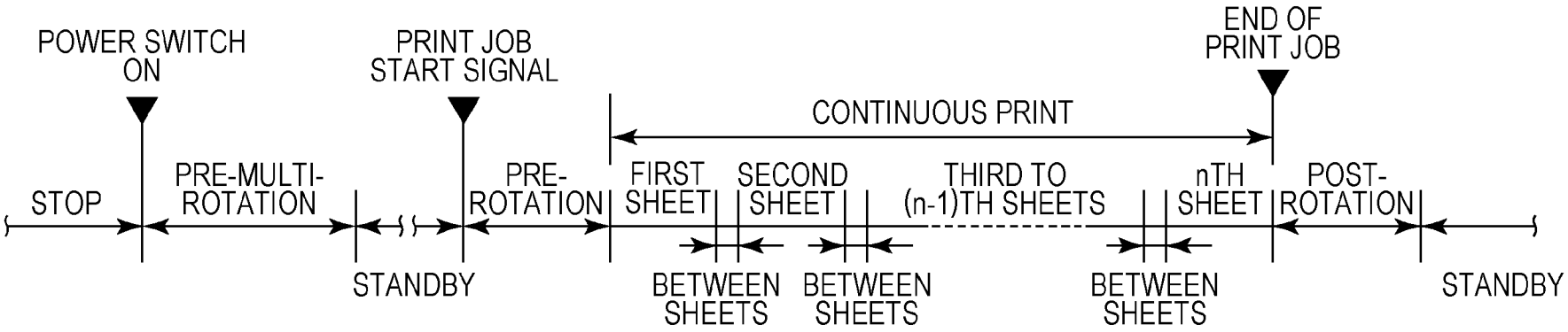
FIG. 2 is a schematic diagram illustrating a series of operations for print job processing in an image forming apparatus applying the present invention.

Next, a series of operations of starting the image forming apparatus, performing image formation and shifting to a standby state will be described with reference to FIG. 2.

1) Pre-multi-rotation operation: starting and warming operations to be performed in response to turning the main power supply switch (not illustrated) from OFF to ON. A main motor (not illustrated) is started, and a preparation operation for required processing apparatuses is performed.

2) Standby: after the predetermined starting operation ends, the driving of the main motor is stopped, and a standby state is held until a print job start signal is input.

3) Pre-rotation Operation: In response to the input of a print job start signal, the main motor is re-driven, and a job preparation operation for required processing apparatuses is performed. More specifically, the job preparation operation includes, in order, a) receiving a print job start signal, b) expanding the image with a formatter, and c) starting a pre-rotation operation. When a print job start signal is input during the 1) pre-multi-rotation operation, the pre-rotation operation is performed sequentially after the pre-multi-rotation operation ends, without the 2) standby.

4) Print Job Execution (image formation operation): when the predetermined pre-rotation operation ends, the image formation process is continuously executed, and an image-formed recorded sheet 15 is output. In continuous print jobs in which printing is performed on a plurality of sheets, the image formation process is repeated, and the recorded sheets having images for a predetermined number of sheets are sequentially output.

5) Inter-sheet: an interval step between the rear end of one recorded sheet 15 and the front end of the next recorded sheet 15 in continuous print jobs, in which no paper passes through a transfer unit and the fuser 16.

6) Post-Rotation Operation: In a print job for one sheet, after the image-formed recorded material is output (at the end of the print job), the main motor is continuously driven, and this operation is executed after the job is finished in the required processing apparatuses. Alternatively, in continuous print jobs, the main motor is continuously driven after the last image-formed recorded material of the continuous print jobs is output (the end of the print job), and the operation is executed after the jobs in the required processing apparatuses are finished.

7) Standby: after the predetermined post-rotation operation ends, the driving of the main motor is stopped, and the image forming apparatus is held in the standby state until the next print job start signal is input.

(3) Configuration of Developing Apparatus

Figure 3:
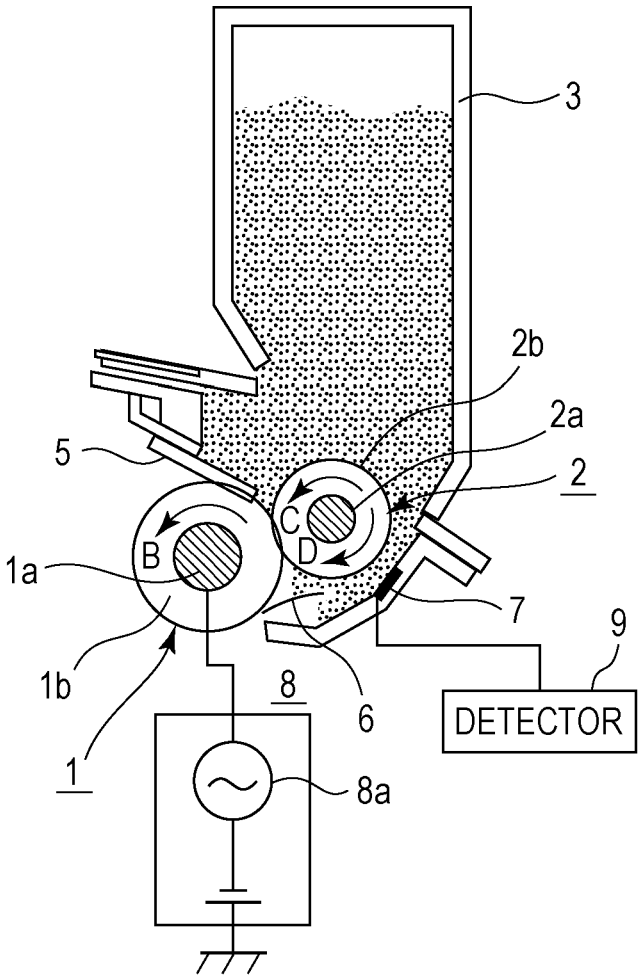
FIG. 3 is a schematic section view illustrating an example of a developing apparatus applying the present invention.

Next, with reference to FIG. 3, the developing apparatus 4 will be described in more detail. The developing apparatus 4 includes a development container 3 which stores toner, a development roller 1 being a toner carrier toner which carries and conveys toner to an electrostatic latent image, a supply roller 2 being a toner supply member which supplies toner to the development roller 1, and an elastic blade 5 being a limiting member which limits the thickness of toner applied to the development roller 1.

The development roller 1 is placed in the opening of the development container 3 to apply pressure to the photoconductor drum 11. The development roller 1 includes a ϕ8 (mm) conductive shaft made of stainless steel, an aluminum alloy or the like and a conductive elastic layer with silicon rubber around the conductive shaft as a base layer. The surface layer of the development roller 1 is coated with an acrylic or urethane rubber. The outer dimension of the development roller 1 is ϕ12 (mm), and the volume resistance is about 10E5 Ωcm. The development roller 1 rotates in the arrow B direction and supplies the toner applied on the surface to an electrostatic latent image on the photoconductor drum 11.

The supply roller 2 is placed to apply pressure to the development roller 1 within the development container 3. The supply roller 2 includes a ϕ6 (mm) conductive shaft 2*a* made of stainless steel, an aluminum alloy or the like and an urethane sponge layer 2*b* being a foam layer around the conductive shaft 2*a*. The outer dimension of the supply roller 24 is ϕ15 (mm), and the volume resistance is about 10E8 Ωcm. The supply roller is placed such that the development roller 25 is intruded into the urethane sponge layer of the supply roller 24 by a amount of intrusion of 1.0 mm (which is equal to the length resulting from the division of the sum of the outer dimensions of the supply roller 24 and the development roller 25 by 2 and the subtraction of the center-to-center spacing from the division result on the segment connecting between the center of the shaft 28 and the center of the shaft 29). The supply roller rotates in the arrow C direction (first direction of rotation) for image formation and supplies the toner on the surface of the foam layer 2*b* and the internal toner to the development roller 1.

The elastic blade 5 is placed such that one end of the elastic blade 5 may give pressure to the development roller. The elastic blade 5 is made of stainless steel or urethane rubber, for example. The elastic blade 5 limits the toner thickness on the development roller to a desirable thickness with the one end giving pressure to the development roller.

(4) Detection of Remaining Amount of Toner

Next, a method for detecting the remaining amount of toner within the development container 3 will be described. This embodiment uses an method in which the capacitance between an antenna 7 and shaft 1*a* provided in the development container 3 is used to detect the remaining amount of toner.

This method will be described below. The image forming apparatus according to this embodiment includes the antenna 7, an AC bias power supply 8*a* and a detector 9 as a remaining-amount-of-toner detecting unit (detector) as follows. An AC bias of frequency 50 KHz and Vpp=200 V is applied from an AC bias power supply 8*a* to the shaft 1*a* as a remaining-amount-of-toner detection bias. The voltage induced in the antenna 7 is detected by the detector 9 to detect the capacitance. The capacitance varies in accordance with the toner amount between the antenna 7 and the shaft 1*a*. Thus, the reference voltage corresponding to the remaining amount of toner to be detected and the detected value may be compared to detect the remaining amount of toner.

(5) Filling Mode (5-1) Flow of Filling Mode

Next, a filling mode for filling up the urethane sponge layer 2*b* with toner, which is a feature of the present invention, will be described. With reference to the flowchart in FIG. 4, the sequence for determining whether the filling mode is to be executed before image formation will be described below. (In this sequence, the operations by the image forming apparatus are controlled by the CPU 20.)

Figure 4:
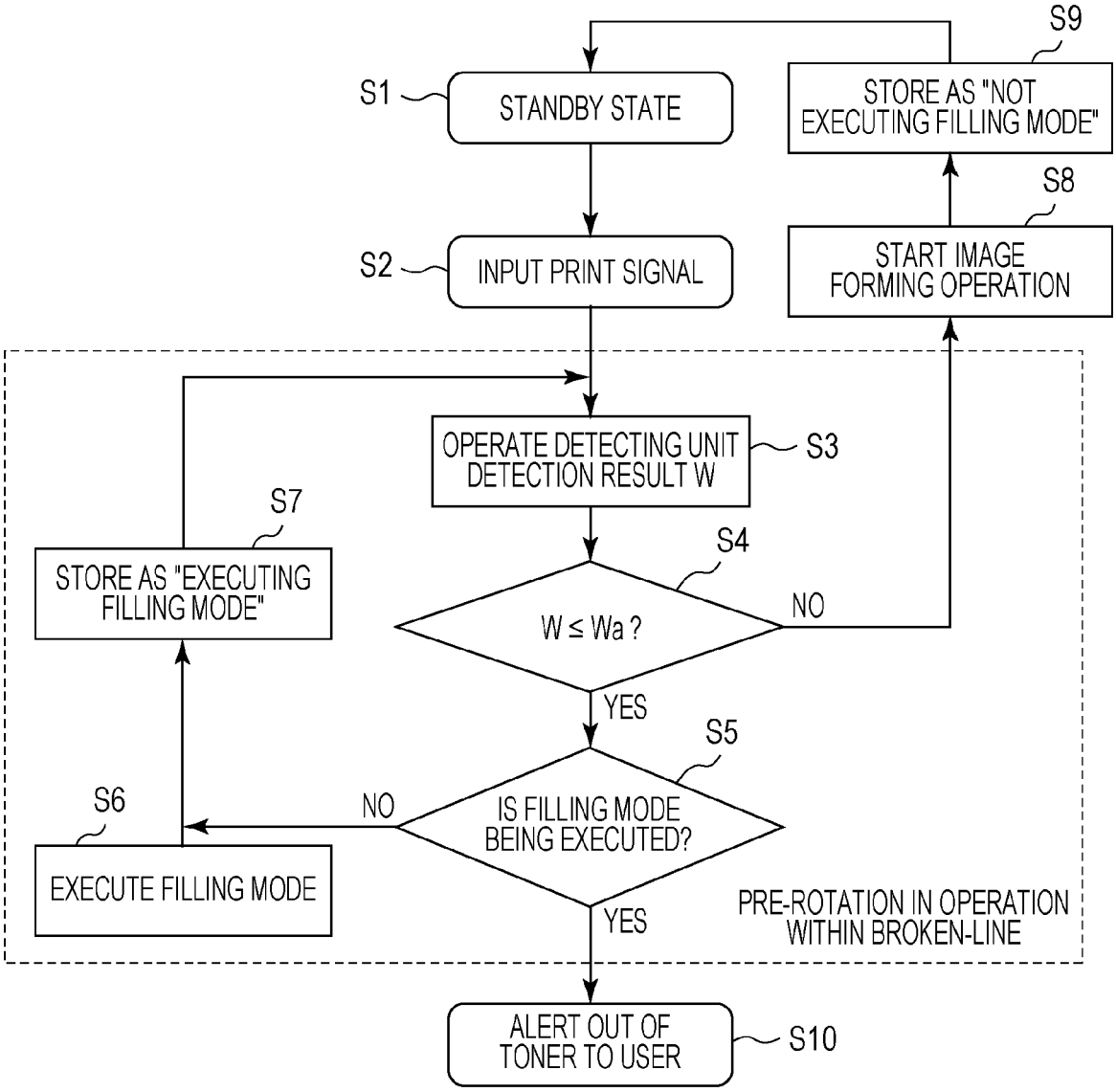
FIG. 4 is a flowchart of a filling mode of a first embodiment and a fourth embodiment.

Referring to the flowchart in FIG. 4, the image forming apparatus first has a standby state (S1). If a print signal is input here (S2), the remaining-amount-of-toner detecting unit detects a remaining amount of toner W in pre-rotation before image formation (S3). The remaining amount of toner W and a threshold value Wa are compared (S4). According to this embodiment, the threshold value Wa is defined to the remaining amount of toner which may possibly cause the decrease of the image density. If W is higher than Wa, the image forming apparatus 10 starts image formation (S8). After the image formation finishes, the state that the filling mode is not being executed is stored (S9), and the image forming apparatus shifts to the standby state (S1). If W is lower than Wa, whether the control is being executed is determined (S5). If the control is not being executed, the filling mode is executed in which the supply roller 2 is rotated in the opposite direction (the D direction in FIG. 3: second direction of rotation) of that for image formation at 40 (rpm) for 10 seconds (S6), and the state that the filling mode is being executed is stored (S7). After that, the remaining amount of toner W is detected again (S3). If the remaining amount of toner is higher than the threshold value, the image formation operation is performed (S8). The state that the toner filling mode is not being executed is stored (S9), and the image forming apparatus shifts to the standby state (S1). If the detected remaining amount of toner W is lower than Wa even though the filling mode is being executed, a display device such as a display unit, not illustrated, of the image forming apparatus may alert the out-of-toner state within the development container to a user (S10).

According to this embodiment, if the remaining amount of toner detected by the remaining-amount-of-toner detecting unit is equal to or lower than a threshold value, the CPU 20 executes the filling mode in which the supply roller 2 is rotated in the opposite direction of that of image formation during pre-rotation or before image formation.

(5-2) Effects and Mechanism of Filling Mode

Figure 5:
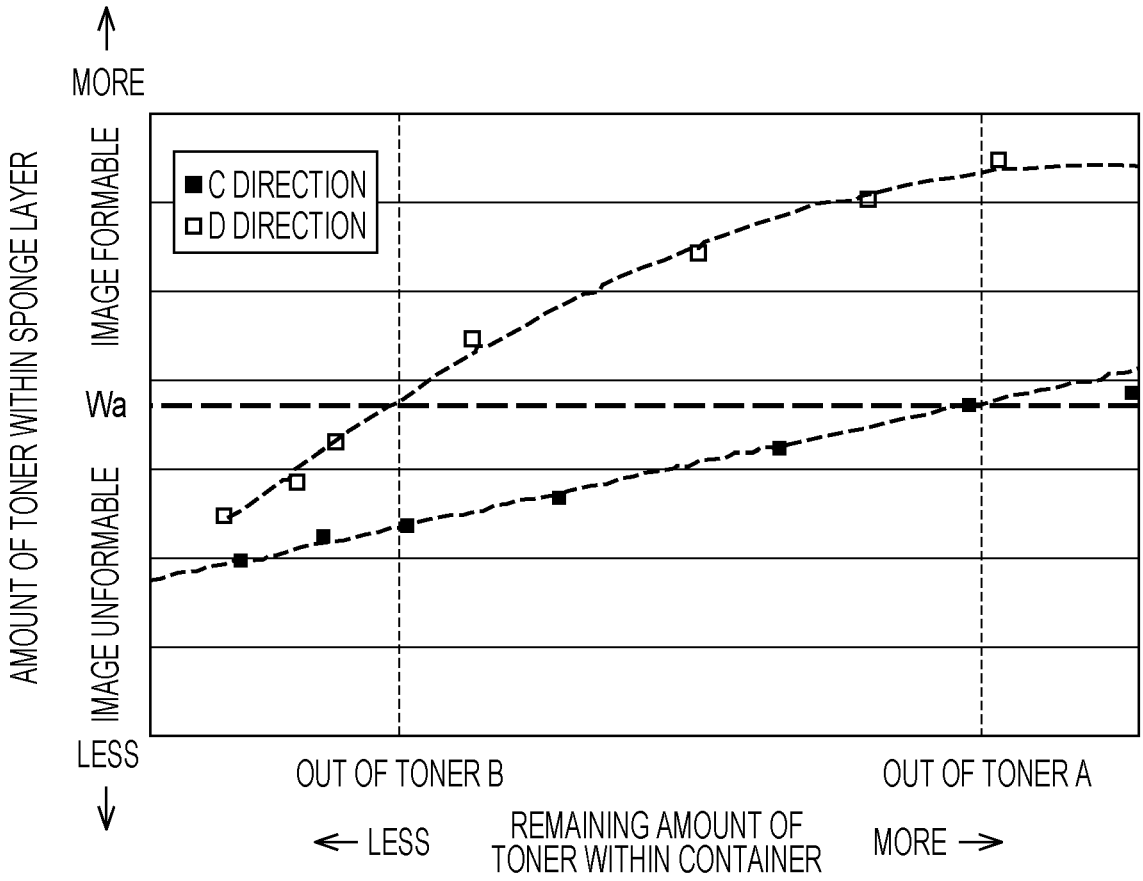
FIG. 5 illustrates a relationship between the toner amount within a development container and the toner amount within a urethane sponge layer.

FIG. 5 illustrates the toner amounts within the urethane sponge layer are compared between before and after the execution of the filling mode. FIG. 5 illustrates the toner amounts within the urethane sponge layer before execution of the filling mode with black plots and the toner amounts within the urethane sponge layer after execution of the filling mode with white plots. A toner amount We within the urethane sponge layer which may possibly reduce the image density is indicated by a thick broken line. FIG. 5 illustrates that the toner amount within the urethane sponge layer is higher after execution of the filling mode than before the execution of the filling mode even within the same development container. The execution of the filling mode of this embodiment increases the toner amount within the urethane sponge layer from that before the execution of the filling mode. This supports maintaining the proper image quality even though the remaining amount of toner within development container is less, unlike technologies of the past. Thus, as indicated by the narrow vertical broken lines, if the filling mode is not executed, keeping the image quality is difficult and the out-of-toner state is required to determine when the toner amount within the development container is A. On the other hand, the execution of the filling mode supports maintaining the image quality until the toner amount within the development container is B. Moreover, the toner accumulated and stayed in an upper part of the contact area of the development roller 1 and supply roller 2 may be effectively used for image formation.

The mechanism for allowing the increase of the toner amount contained within the urethane sponge layer by the filling mode of this embodiment from before the execution of the filling mode will be described below.

Figure 6A:
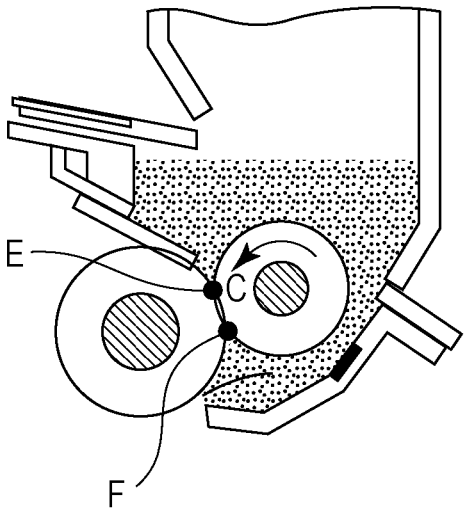
FIG. 6A illustrates a state with a more remaining amount of toner within a development container.

First, the movement of toner to and from the foam layer with the rotation of the supply roller will be discussed with reference to FIG. 6A and FIG. 6B. As described above, the supply roller 2 is placed in contact with the development roller 1 with pressure. When the supply roller 2 rotates in the C direction, the urethane sponge layer is compressed at an E part (at an uppermost stream position in the C direction of rotation of the supply roller in the contact area of the development roller 1 and supply roller 2) where the contact with the development roller 1 starts. The toner within the urethane sponge layer is pushed out from the urethane sponge layer. The toner is supplied to the development roller at a nip to the development roller by further rotation. The urethane sponge layer is released from the compression at an F part (at a lowermost stream position in the C direction of rotation of the supply roller in the contact area of the development roller 1 and supply roller 2) after passing through the nip. The toner on the development roller and the toner around the F part are absorbed. In other words, the urethane sponge layer absorbs the toner in the F part and ejects the toner in the E part. Repeating this process may keep the state that the foam layer contains toner sufficiently if the remaining amount of toner is sufficient within the development container 3 as illustrated in FIG. 6A.

Figure 6B:
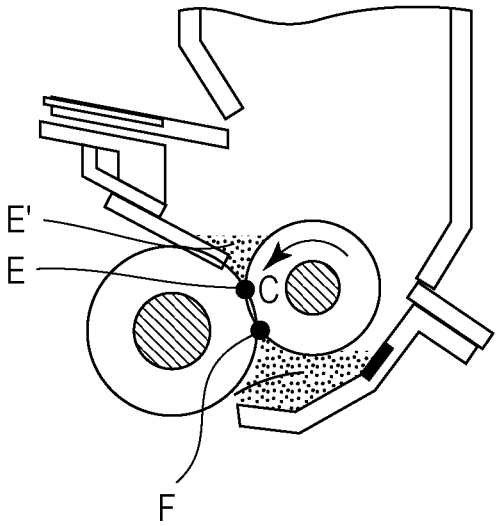
FIG. 6B illustrates a state with a less remaining amount of toner within the development container.

However, if the remaining amount of toner is less and the level of the toner is lower than the F part as illustrated in FIG. 6B, the absorption of toner at the F part by the urethane sponge layer is difficult. On the other hand, toner is ejected at the E part. Thus, if the toner coated surface is lower than F part, the toner amount contained within the urethane sponge layer easily decreases, possibly preventing keeping the proper image density.

Under this state, the supply roller is rotated in a D direction which is the opposite direction of that of image formation for a predetermined period of time according to this embodiment to increase the toner amount within the urethane sponge layer. When the supply roller is rotated in the D direction, the urethane sponge layer is compressed at the F part and is released from the compression at the E part. Thus, the urethane sponge layer absorbs toner at the E part and ejects toner at the F part. When the direction of rotation of the supply roller is changed from the C direction to the D direction, the toner ejected from the urethane sponge layer when the supply roller is rotating in the C direction (the toner piled at an upper part of an E' part of the contact area of the development roller and toner supply roller) may be absorbed into the urethane sponge layer when the supply roller rotates in the D direction. Thus, even when the toner coated surface is lower than the F part, the absorption of toner into the urethane sponge layer can provide temporary storage of toner within the urethane sponge layer which is required for a proper image density.

(6) Supplementary Explanation

According to this embodiment, the filling mode is executed if the remaining amount of toner detected by the remaining-amount-of-toner detecting unit is equal to or lower than a predetermined amount. However, the filling mode may be executed at an arbitrary time while image formation is not being performed in response to a request by a user to execute the filling mode through an control panel (not illustrated) a PC monitor of the image forming apparatus.

According to this embodiment, in the filling mode, the supply roller is rotated in the D direction for 10 seconds as the predetermined period. If the period is too long, the toner piled in an upper part of the E part is completely absorbed into the urethane sponge layer. On the other hand, the toner within the urethane sponge layer is ejected from the F part, and the toner within the urethane sponge layer may possibly decrease. To increase the toner amount contained in the urethane sponge layer after the predetermined period, an optimum predetermined period may be set on the basis of the result of an experiment in advance. The increase of the toner amount contained within the urethane sponge layer may be checked by measuring the weight of the supply roller.

According to this embodiment, a remaining-amount-of-toner detecting unit having an antenna within a development container is used. However, various remaining-amount-of-toner detection methods may be used such as optical remaining-amount-of-toner detection using a photosensor in the past and remaining-amount-of-toner detection based on the toner consumption calculated by using print dots in an image signal.

To prevent the execution of the filling mode more than necessary, the filling mode is desirably executed if the toner coated surface is lower than the F part. Similarly, the remaining-amount-of-toner detecting unit desirably may detect whether the toner coated surface is lower than the F part. According to this embodiment, the antenna 7 is positioned on the straight line connecting the center of the shaft 1*a* and the F part for highly precise detection of whether the toner coated surface is lower than the F part. The present invention is also applicable to an image forming apparatus having a plurality of process cartridges to acquire a full-color image in a similar form to this embodiment.

Next, a second embodiment of the image forming apparatus according to the present invention will be described. In the following description, repeated description of the same parts as those of the first embodiment will be omitted.

According to this embodiment, the filling mode is executed during post-rotation or after image formation. According to the first embodiment, the filling mode is executed during pre-rotation or before image formation. However, because image formation is not performed until the filling mode completes, the pre-rotation time may sometimes be longer than before. On the other hand, according to this embodiment, because the filling mode is executed during post-rotation or after image formation, the time required until starting image formation may be reduced relative to the first embodiment.

With reference to the flowchart in FIG. 7, the sequence for determining whether the filling mode is to be executed will be described.

Figure 7:
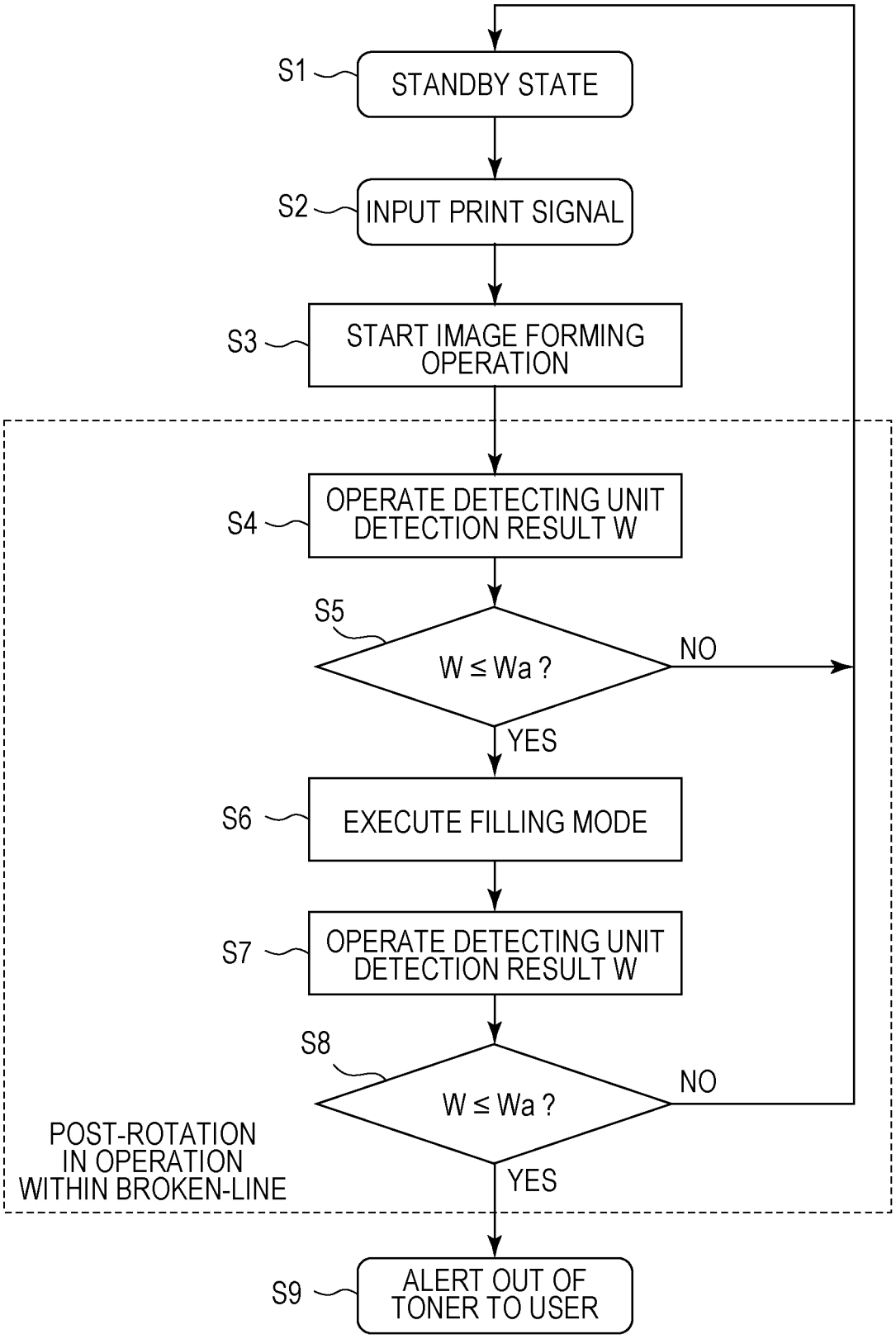
FIG. 7 is a flowchart of a filling mode of a second embodiment.

Referring to the flowchart in FIG. 7, the image forming apparatus first has a standby state (S1). If a print signal is input here (S2), the image forming apparatus 10 performs image formation (S3). The remaining-amount-of-toner detecting unit detects a remaining amount of toner W in post-rotation after image formation (S4), and the remaining amount of toner W and a threshold value Wa are compared (S5). The threshold value Wa is defined to the remaining amount of toner which may possibly cause the decrease of the image density, like the first embodiment. If W is higher than Wa, the image forming apparatus shifts to a standby state (S1). If W is lower than Wa, the filling mode is executed in which the supply roller 2 is rotated in the opposite direction (the D direction in FIG. 3) of that for image formation at 40 (rpm) for 10 seconds (S6). After that, the remaining amount of toner W is detected (S7), and W and the threshold value Wa are compared (S8). If W is higher than Wa, the image forming apparatus shifts to the standby state (S1). If W is lower than Wa, a display device such as a display unit, not illustrated, of the image forming apparatus may alert the out-of-toner state within the development container to a user (S9).

According to this embodiment, if the remaining amount of toner detected by the remaining-amount-of-toner detecting unit is equal to or lower than a threshold value, the filling mode is executed in which the supply roller 2 is rotated for a predetermined period of time in the opposite direction of that of image formation during post-rotation or after image formation. The execution of the filling mode of this embodiment increases the toner amount within the urethane sponge layer from that before the execution of the filling mode. Like the first embodiment, this supports maintaining the proper image quality even though the remaining amount of toner within development container is less, unlike technologies of the past. Moreover, toner accumulated and stayed in an upper part of the contact area of the development roller 1 and supply roller 2 may be effectively used for image formation.

Next, a third embodiment of the image forming apparatus according to the present invention will be described. In the following description, repeated description of the same parts as those of the first embodiment will be omitted.

An image forming apparatus of this embodiment calculates the rotation rate of a supply roller which can perform image formation by using the remaining amount of toner on the basis of the remaining amount of toner detected by a remaining-amount-of-toner detecting unit. At the rotation rate, continuous printing is temporarily stopped between sheets, and the filling mode is executed. According to this embodiment, this control may prevent the generation of a low density image during continuous printing even when the number of sheets to be printed continuously by one printing operation.

Figure 8:
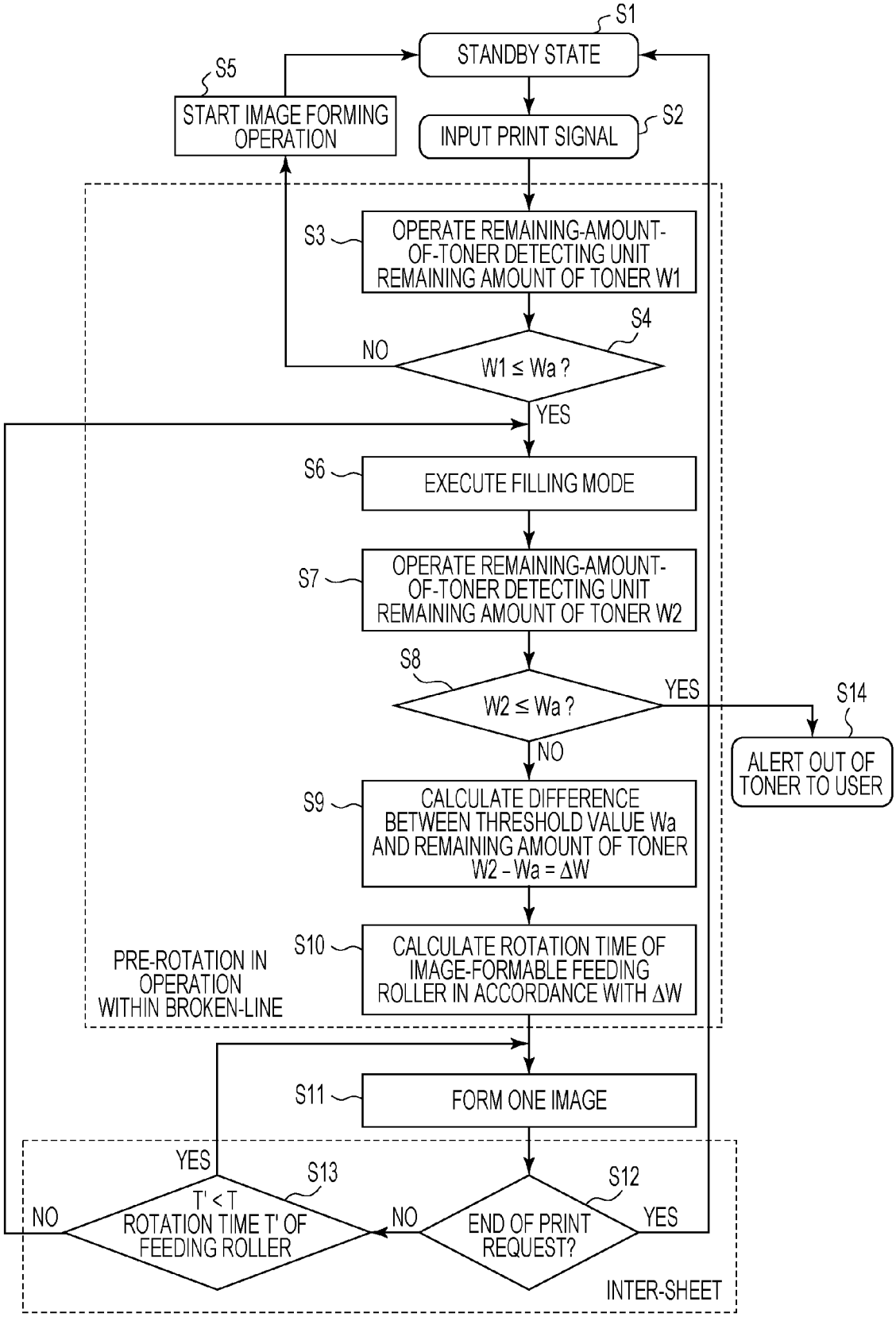
FIG. 8 is a flowchart of a filling mode of a third embodiment.
Figure 9:
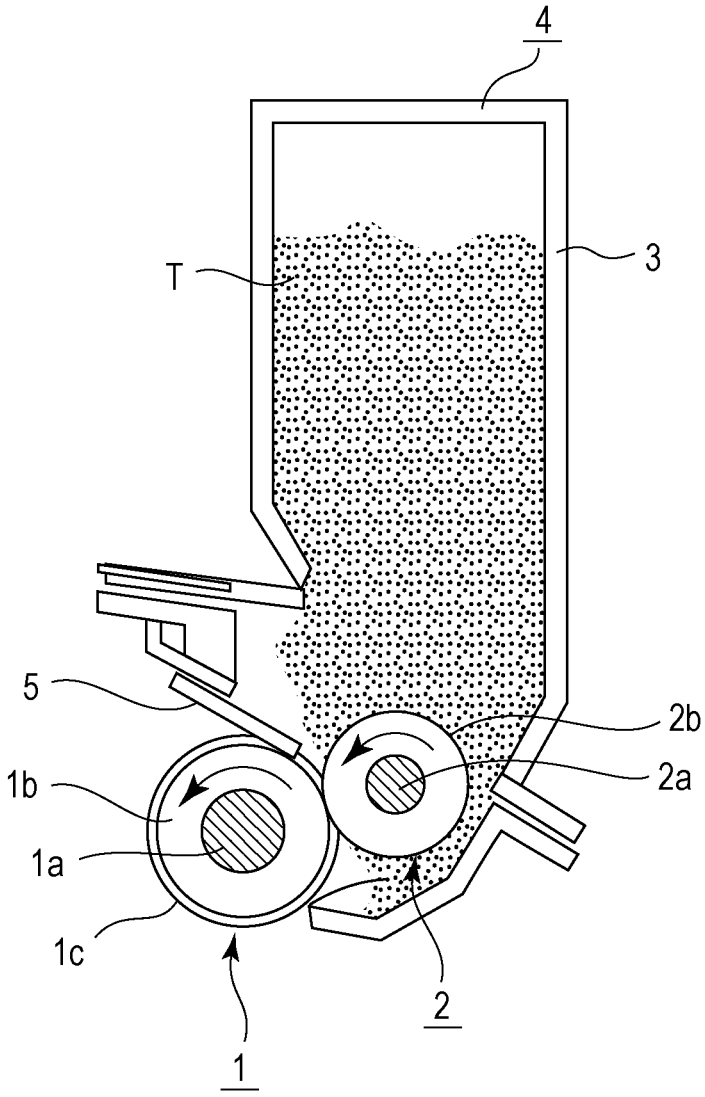
FIG. 9 illustrates a developing apparatus of a technology in the past.

With reference to the flowchart in FIG. 8, the sequence for determining whether the filling mode is to be executed according to this embodiment will be described below. Referring to the flowchart in FIG. 8, the image forming apparatus first has a standby state (S1). If a print signal is input here (S2), the remaining-amount-of-toner detecting unit detects a remaining amount of toner W1 in pre-rotation before image formation (S3), and the remaining amount of toner W1 and a threshold value Wa are compared (S4). If W1 is higher than Wa, the image forming apparatus 10 performs image formation (S5). After the image formation finishes, the image forming apparatus shifts to the standby state (S1). If W1 is lower than Wa, the filling mode is executed in which the supply roller 2 is rotated in the opposite direction (the D direction in FIG. 3) of that for image formation at 40 (rpm) for 10 seconds (S6). After the execution of the filling mode, the remaining-amount-of-toner detecting unit detects a remaining amount of toner W2 again (S7), and the remaining amount of toner W2 and the threshold value Wa are compared (S8). If W2 is higher than Wa, image formation may be performed. The difference AW between W2 and Wa is calculated (S9). In accordance with AW, a rotation time T of the supply roller for image formation is determined (S10). After that, image formation is performed on one sheet (S11), and whether the print request has been processed completely is determined (S12). If the print request has been processed completely, the image forming apparatus shifts to the standby state (S1). If the print request has not been processed completely, the filling mode is executed, and the time T' for rotation in the C direction by the supply roller for image formation and T are compared (S13). If T' is shorter than T, image formation is performed on another sheet (S11). These operations are repeated, and the print request are processed completely (S12). Alternatively, the comparison between T' and T is performed for every printing on one sheet until T' is equal to or higher than T (S13). If the print request has been processed completely (S12) and T' is higher than T (S13), the filling mode is executed again (S6). After that, (S7) to (S12) are performed, and if the print request has been processed completely in (S12), the image forming apparatus shifts to the standby state (S1). If the remaining amount of toner W2 after the execution of the filling mode is lower than Wa, a display device such as a display unit, not illustrated, of the image forming apparatus may alert the out-of-toner state within the development container to a user (S14).

According to this embodiment, based on the remaining amount of toner detected by the remaining-amount-of-toner detecting unit, the rotation rate of a supply roller which may perform image formation by using the remaining amount of toner is calculated. At the rotation rate, the continuous printing is temporarily stopped between sheets, and the filling mode is executed. The filling mode of this embodiment may prevent the generation of a low density image during continuous printing even when the number of sheets to be printed continuously by one printing operation. The toner accumulated and stayed in an upper part of the contact area of the development roller 1 and supply roller 2 may be effectively used for image formation.

According to this embodiment, the rotation rate of a supply roller which may perform image formation by using the remaining amount of toner is set. However, it may be the amount allowing image formation which is deducted from the remaining amount of toner. For example, the rotation rate of the development roller or the number of sheets to undergo image formation (the number of sheets to be printed) may be set.

Next, a fourth embodiment of the image forming apparatus according to the present invention will be described. In the following description, repeated description of the same parts as those of the first embodiment will be omitted.

In an image forming apparatus of this embodiment, the density of a density detection image (hereinafter, called a patch) formed on the photoconductor drum 11 is detected by a density sensor 19 being density detecting unit. If the density detected by the density sensor 19 is equal to or lower than a predetermined density, a filling mode is executed. The quantity of reflected light which is an optical characteristic of the patch is detected by a density sensor 19 including a light emitting element and a light receiving element to detect the density.

With reference to the flowchart in FIG. 4, the sequence for determining whether the filling mode is to be executed according to this embodiment will be described below. Referring to the flowchart in FIG. 4, the image forming apparatus first has a standby state (S1). If a print signal is input here (S2), the density sensor 19 detects a density W of the patch (S3) in pre-rotation before image formation, and the density W and a threshold value Wa are compared (S4). According to this embodiment, the threshold value Wa is set to the remaining amount of toner which may possibly cause the start of the decrease of image density. If W is higher than Wa, the image forming apparatus 10 performs image formation (S8). After the image formation finishes, the state that the filling mode is not being executed is stored (S9), and the image forming apparatus shifts to the standby state (S1). If W is lower than Wa, whether the filling mode is being executed is determined (S5). If the filling mode is not being executed, the filling mode is executed in which the supply roller 2 is rotated in the opposite direction (the D direction in FIG. 3) of that for image formation at 40 (rpm) for 10 seconds (S6), and the state that the filling mode is being executed is stored (S7). After that, the density sensor 19 detects the density W again (S3). If the density W is higher than the threshold value Wa, image formation is performed (S8). The state that the filling mode is being executed is stored (S9). The image forming apparatus shifts to the standby state (S1). If the detected density W is lower than Wa even though the filling mode is executed, a display device such as a display unit, not illustrated, of the image forming apparatus may alert the out-of-toner state within the development container to a user (S10).

Like the first embodiment, the execution of the filling mode of this embodiment increases the toner amount within the urethane sponge layer from that before the execution of the filling mode. This supports maintaining the proper image quality even though the remaining amount of toner within development container is less, compared with technologies in the past. Moreover, the toner accumulated and stayed in an upper part of the contact area of the development roller 1 and supply roller 2 may be effectively used for image formation.

According to this embodiment, the filling mode may be executed at the amount allowing image formation deducted on the basis of the density detection result, like the calculation of the rotation rate of a supply roller which may perform image formation on the basis of the remaining amount of toner in the third embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-277314 filed Dec. 13, 2010, which is hereby incorporated by reference herein in its entirety.

What is claimed is:

1. An image forming apparatus comprising:

an image carrier which carries an electrostatic latent image;

a container which has an opening and contains toner;

a toner carrier provided in the opening and carries and conveys the toner to the electrostatic latent image;

a toner supply member which is in contact with the toner carrier and is provided within the container, has a foam layer on its surface, rotates in a predetermined direction for image formation and supplies the toner to the toner carrier and has a contact area with the toner carrier with an uppermost stream position in the predetermined direction of the contact area being higher than a lowermost stream position;

a detector which detects the toner amount within the container; and a control unit which executes a mode for rotating the toner supply member in the opposite direction of the predetermined direction to increase the toner amount contained in the foam layer in response to the toner amount within the container detected by the detector being equal to or lower than a predetermined amount.

2. The image forming apparatus according to claim 1, wherein the control unit does not execute the mode until the toner amount within the container detected by the detector falls to the predetermined amount.

3. The image forming apparatus comprising:

an image carrier which carries an electrostatic latent image;

a container which has an opening and contains toner;

a toner carrier which is provided in the opening and carries and conveys the toner to the electrostatic latent image;

a toner supply member which is in contact with the toner carrier and is provided within the container, has a foam layer on its surface, rotates in a predetermined direction for image formation and supplies the toner to the toner carrier and has a contact area with the toner carrier with an uppermost stream position in the predetermined direction of the contact area being higher than a lowermost stream position;

a detector for detecting the density of a predetermined image;

a control unit which executes a mode for rotating the toner supply member in the opposite direction of the predetermined direction to increase the toner amount contained in the foam layer in response to the density detected by the detector being equal to or lower than a predetermined density.

4. The image forming apparatus according to claim 3, further comprising a detector which detects the density of a predetermined image, wherein the control unit does not execute the mode until the density detected by the detector falls to a predetermined density.

5. The image forming apparatus according to claim 1, wherein the control unit executes the mode after receiving an image formation start signal and before performing image formation.

6. The image forming apparatus according to claim 1, wherein the control unit executes the mode after performing image formation and before shifting to a standby state.

7. The image forming apparatus according to claim 1, wherein the control unit executes the mode in accordance with a request from a user.

8. The image forming apparatus according to claim 3, wherein the control unit executes the mode after receiving an image formation start signal and before performing image formation.

9. The image forming apparatus according to claim 3, wherein the control unit executes the mode after performing image formation and before shifting to a standby state.

10. The image forming apparatus according to claim 3, wherein the control unit executes the mode in accordance with a request from a user.

* * * * *